US005153056A

United States Patent [19]

Groshens

[11] Patent Number: 5,153,056

[45] Date of Patent: Oct. 6, 1992

[54] TEXTILE FOR LININGS AND METHOD OF MANUFACTURING SAME

[75] Inventor: Pierre Groshens, Doingt-Flamincourt, France

[73] Assignee: Lainiere De Picardie, Peronne, France

[21] Appl. No.: 485,891

[22] Filed: Feb. 28, 1990

[30] Foreign Application Priority Data

Mar. 31, 1989 [FR] France ..... 89 04247

[51] Int. Cl.[5] ..... B32B 3/00; B32B 5/00

[52] U.S. Cl. ..... 428/253; 428/224; 428/227; 428/234; 428/284; 428/286; 428/288; 28/104; 28/108; 28/103; 162/108; 162/109; 162/227

[58] Field of Search ..... 428/284, 286, 288, 224, 428/227, 234, 253; 162/108, 109, 227; 28/104, 108, 103

[56] References Cited

U.S. PATENT DOCUMENTS 3,129,466 4/1964 L'Hommedieu ..... 19/145
4,190,695 2/1980 Niederhauser ..... 428/284

*Primary Examiner*—Patrick J. Ryan
*Assistant Examiner*—Richard Weisberger
*Attorney, Agent, or Firm*—Mason, Fenwick & Lawrence

[57] ABSTRACT

The invention relates to a lining textile and a method of manufacturing same.

It comprises a woven or knitted textile support (1) and at least one non-woven layer (2).

According to the invention, the non-woven layer or layers (2) are bonded to the knitted or woven textile support (1) by fluid jet needling.

20 Claims, 1 Drawing Sheet

TEXTILE FOR LININGS AND METHOD OF MANUFACTURING SAME

The invention relates to a textile for linings and a method of manufacturing same.

It relates more particularly to textiles for lining garment fronts, shirt and blouse necks, shirt and dress fronts, co-garment fronts, reinforcements or covers therefor, or garment fronts.

These products are intended to give to the textile or fabrics on which they are fixed and to the clothes the feel, flexibility and pliancy which they do not have by themselves.

Textiles are already known for linings incorporating a non-woven textile layer. For example, according to the patent FR-A-2 233 496, a web is described comprising at least one layer of non-woven and non oriented fibres and at least one layer of additional fibres having a high degree of orientation. These layers are sewn together by synthetic threads and coating thereof for forming a heat-bonding textile product is envisaged.

The technique of bonding a non-woven layer by fluid jet is also known. In this technique, fibres are fed in the form of a layer in front of nozzles producing high pressure fluid jets. These jets cause tangling of the fibres which improves or gives cohesion to the layer. It is known that the number and properties of fluid jets determine the properties of the resulting non-woven layer.

The patent FR-A-2 339 697 (ASAHI) relates to a composite material comprising a layer of woven or knitted material and a non-woven layer whose individual fibres penetrate inside the preceding layer. The association of the non-woven layer with the woven or knitted layer is achieved by means of a fluid jet and this association is possibly preceded by the formation of the non-woven material also by fluid jet. This composite material is mainly intended to serve as base for manufacturing artificial leather. It may form a substrate having high flexibility and strength whose internal structure is closer to that of natural leather than that of a conventional type non-woven material.

The German patent application DE-A-2 828 394 (MITSIBISHI RAYON CO. LTD.) relates to the manufacture of a material formed of a basic textile and a material with short fibres formed at least partially of natural fibres. The basic textile and the short fibre material are associated by the partial penetration of short fibres in the gaps of the network formed by the basic textile. The desired objective is to give a natural appearance to a product formed from a base which is not so.

Furthermore, the document DE-A-1 956 605 (RADUNER) relates to a heat-bonding lining covered with a spot coating.

The association of a knitted or woven textile support and a non-woven layer for forming a heat-bonding textile for linings has numerous advantages.

The support gives the textiles good cohesion, good pliancy and make it unstretchable at least in one direction. The non-woven layer contributes to giving it a particular volume and surface feel.

However, the practical formation of this type of product presents difficulties which make high speed manufacture difficult and contributes to giving such products a high price which up to now has slowed down their spread. The problem of the invention is therefore to provide a new product comprising a knitted or woven textile support and at least one non-woven layer whose manufacture may be reliable, relatively simple and inexpensive.

For this, the invention relates to a textile for linings of the type comprising a knitted or woven textile support and at least one non-woven layer.

According to the invention, the non-woven layer or layers are bonded to the knitted or woven textile support by fluid jet needling.

The invention also relates to a method of manufacturing a textile for linings of the type in which at least one non woven textile layer and a knitted or woven textile support advancing continuously at the same speed are placed in contact.

According to the invention, the non woven textile layer or layers are bonded by fluid jet to the knitted textile support, the water is extracted and the textile obtained is dried, and is then subjected to finishing operations.

The invention will be described in greater detail with reference to the figures in which.

Figure 1:
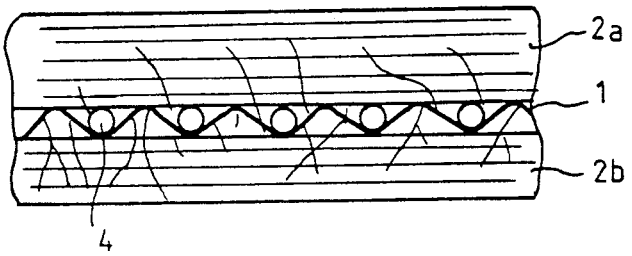
FIG. 1 shows schematically the textile of the invention seen in section.
Figure 2:
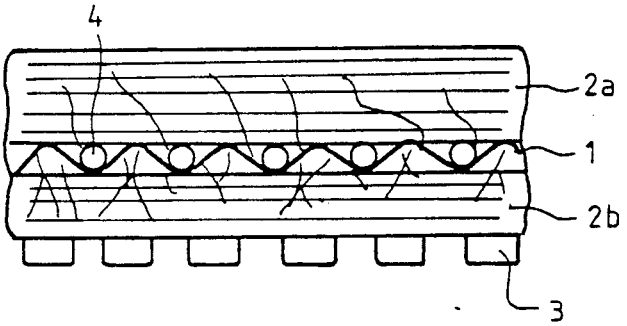
FIG. 2 is a schematic representation of the textile of the invention with a thermo-adhesive layer seen in section.
Figure 3:
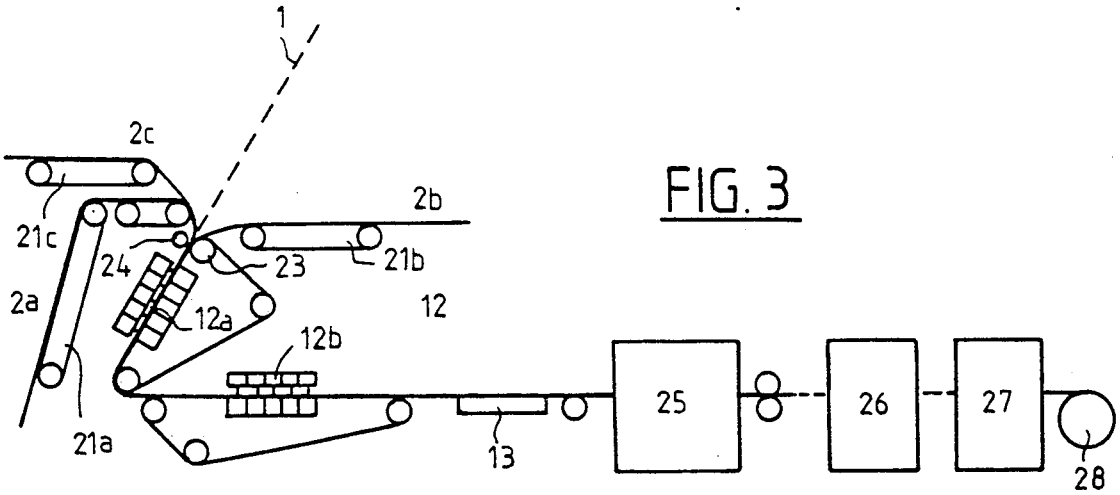
FIG. 3 is a representation of the different steps of the manufacturing method according to the invention.

The textile for linings comprises a knitted or woven textile support 1 and at least one non-woven layer 2. It may possibly comprise a thermo-adhesive coating layer 3.

The textile support 1 is of the same type as the fabrics usually used in the lining field. it may be made with synthetic fibres, for example polyester or polyamide or else natural or artificial fibres.

This support is woven or preferably knitted. It has a contexture and comprises threads of sizes adapted to the desired aims (pliancy, flexibility, elasticity, strength). It is for example formed of a woven knitted fabric with a long weft.

The non woven layer or layers 2 are formed in a way known per se. They may be formed preferably of synthetic, artificial or natural carded fibres, which are oriented or not, chosen as a function of the volume and of the feel of the textile complex which they are to form. The size of the fibres may vary from 0.3 decitex for light linings up to 10 to 15 decitex for heavy linings, for example for garment fronts. Synthetic, artificial staple fibers are usually about 1½" to 6" (about 3 cm to 15 cm) in length.

The layer of fibres may undergo beforehand pre-needling, heat-bonding or any other "pre-bonding".

The non-woven fibres may also be replaced by directly extruded synthetic non-woven filaments.

The non-woven layer or layers 2 are bonded to the knitted or woven textile support 1 by fluid jet needling. Thus, by the effect of the jets, some fibres of the non-woven layer are tangled in the support fabric and provide the connection between the non-woven layer or layers 2 and the textile support 1.

Fluid jet needling also provides cohesion of the whole of the non-woven layer 2.

The textile support 1 may be associated with two non-woven layers 2*a, b* each situated on one of its sides. The textile support 1 is then inserted between two non-woven layers 2 to which it gives particular properties (pliancy, stretch control, strength, etc . . . ).

It is also possible to associate several non-woven layers 2 on the same side of the textile support 1, the whole of the layers then being associated together and associated with the textile support 1 by fluid jet needling.

The textile may comprise a thermo-adhesive coating layer 3, preferably formed by spot coating using for example an etching cylinder of the silk-screen printing type. The thermoplastic polymers used for this purpose may be polyethylenes, polyamides, modified vinyl acetates, polyesters, etc . . .

The properties of the textile result from the combination of the properties of its different components. Thus, for forming garment fronts, a pliant textile support is used to which the non-woven fibre layer or layers confer a volume and surface feel. For garment front coverings, as textile support 1 a mesh pattern or warp weave and deformable weft are used associated with very voluminous non-woven fibre layers 2.

Reinforcement heat-bonding textiles may be obtained by using as textile support more or less thick and more or less resilient mesh which will be associated with one or more layers of extruded filaments or fibres 2 (Spun bond; Melt blown) which are not woven. In the latter case, the layers of fibres 2 will have as main functions to fill up the gaps between the threads of the textile support 1, namely to close the contexture of this textile. That will eliminate flow of the thermo-adhesive coating during heat-bonding to garments and give a volume to the heat-bonding product.

To manufacture a composite textile for linings, at least one non-woven textile layer 2 and a knitted or woven textile support 1 advancing continuously at the same speed are placed in contact 11. Then the non woven textile layer or layers is bonded 12 by fluid jet to the knitted or woven textile support 1, the residual water 13 is removed and the textile obtained is dried.

Then it is subjected to finishing operations 26. Then, possibly, a thermo-adhesive layer 27 is deposited.

Generally, the non-woven textile layer 2 is brought on to a conveyor 21. However, when it is pre-needled, it may be brought by itself without being supported by a conveyor.

The textile support 1 has generally been manufactured previously and is stored. The non-woven layer 2 and support 1 are placed in contact at the level of rollers 23 and 24. An assembly of nozzles 12 then subjects the non-woven layer 2 to an assembly of fluid jets which cause tangling of fibres in the non-woven layer 2 and in the support textile 1 providing simultaneously cohesion of the non-woven layer 2 and engagement on support 1. The non-woven textile layer 2 now associated with support 1 is dried in enclosure 25, then subjected at 26 to the finishing operations. Coating may be provided at 27. The product obtained is then stored at 28. The different drying 25, finishing 21 and coating 27 operations are not described in detail, each being known per se. Intermediate storage of the textile may be provided between these different phases or even during one or some of them.

In order to produce a textile for linings comprising a non-woven layer 2*a* on each side of the knitted textile support 1, a second layer 22*b* may be brought on to a conveyor 21*b* and placed in contact with the textile support 1 by means of rollers 23 and 24. A second set of nozzles 12*b* is then situated in the path of the textile after the first set 12*a* and so as to act on the other face of the textile.

In order to associate several non-woven textile layers 2 on the same side of the textile support 1, a second layer 2*c* may be brought by conveyor 21*c* in contact with the first layer 2*a* and the set of nozzles 12 then provides simultaneously connection of the non-woven layers together and connection of these layers to the textile support 1. Similarly, different configurations may be achieved by associating a variable number of non-woven layers 2, either all situated on the same side of support 1, which then requires only one set of nozzles 12 producing fluid jets, or situated on each side of the textile support 1, which then requires two sets of needling nozzles 12*a* and 12*b* placed respectively on each side of the composite textile.

This method of manufacture makes it possible to obtain fabrics for linings having varying qualities of pliancy, volume and feel depending on the properties of the different components. These fabrics may receive a thermo-adhesive layer.

I claim:

1. A composite textile, suitable for use as an interlining, comprising:

a knitted or woven textile support; and at least one non-woven layer, wherein:

said non-woven layer comprises fibers, and wherein a portion of said fibers are tangled in said support, said fibers tangled in said support being sufficient by themselves to bond said non-woven layer to said support, and wherein said non-woven layer and said support retain the surface feel on their unbonded sides of an unbonded non-woven layer and an unbonded support, respectively.

2. A textile according to claim 1, wherein said fibers have a size ranging from about 0.3 decitex to about 15 decitex.

3. A textile according to claim 1, wherein said at least one non-woven layer is pre-needled.

4. The textile according to claim 1, wherein said at least one non-woven layer comprises at least two non-woven layers located on one side of said support.

5. The textile according to claim 1, wherein said support is a knitted fabric.

6. The textile according to claim 5, wherein said support is a knitted fabric with weft.

7. The textile according to claim 1, wherein said support is woven.

8. The textile according to claim 1, further comprising a thermo-adhesive coating layer on an unbonded surface.

9. A textile according to claim 2, wherein said at least one non-woven layer is pre-needled.

10. A textile according to claim 2, wherein said at least one non-woven layer comprises at least one non-woven layer situated on opposite sides of said support.

11. The textile according to claim 2, wherein said at least one non-woven layer comprises at least two non-woven layers located on one side of said support.

12. The textile according to claim 2, wherein said support is a knitted fabric.

13. The textile according to claim 12, wherein said support is a knitted fabric with weft.

14. The textile according to claim 2, wherein said support is woven.

15. The textile according to claim 2, further comprising a thermo-adhesive coating layer on an unbonded surface.

16. An interlining textile comprising:

a knitted or woven textile support; and at least one non-woven layer, wherein said at least one non-woven layer is bonded to said support, said non-woven layer comprising fibers, wherein a portion said fibers are tangled in said support, said fibers tangled in said support being sufficient by themselves to bond said non-woven layer to said support, and wherein said at least one non-woven layer retains the surface feel on the unbonded side of an unbonded non-woven layer, said at least one non-woven layer being pre-needled, said at least one non-woven layer comprising at least two non-woven layers, at least one of said at least two non-woven layers being located on each of the opposite sides of said textile support, said support being a knitted fabric with weft, and further comprising a thermo-adhesive coating layer on an unbonded surface.

17. A composite textile, suitable for use as an interlining, comprising:

a knitted or woven textile support; and at least one non-woven layer, wherein:

said non-woven layer comprises fibers, and said non-woven layer is bonded to said support by tangling a portion of said fibers in said support, said fibers tangled in said support being sufficient by themselves to bond said non-woven layer to said support, and wherein said fibers have a length greater than about 3 cm.

18. A textile according to claim 17, wherein said at least one non-woven layer comprises at least two non-woven layers situated on opposite sides of said support.

19. A textile according to claim 17, wherein said fibers have a size ranging from about 0.3 decitex to about 15 decitex.

20. A composite textile, suitable for use as an interlining, comprising:

a knitted or woven textile support; and at least one non-woven layer, wherein:

said non-woven layer comprises fibers, and said non-woven layer is bonded to said support by tangling a portion of said fibers in said support, said fibers tangled in said support being sufficient by themselves to bond said non-woven layer to said support, and wherein said fibers have a size ranging from about 0.3 decitex and 15 decitex.

* * * * *